United States Patent [19]

Umeda et al.

[11] 4,147,262

[45] Apr. 3, 1979

[54] EXCAVATING AND LOADING MACHINE MOUNTED ON A WHEELED TYPE VEHICLE

[75] Inventors: Haruhiko Umeda, Yokohama; Masaru Uenoyama, Kawasaki; Kotoshige Ishizuki, Yokohama; Hideo Hara, Kawasaki, all of Japan

[73] Assignee: Kabushiki Kaisha Komatsu Seisakusho, Tokyo, Japan

[21] Appl. No.: 809,700

[22] Filed: Jun. 24, 1977

[30] Foreign Application Priority Data

Jun. 29, 1976 [JP] Japan ..... 51-76033
Jun. 29, 1976 [JP] Japan ..... 51-76034

[51] Int. Cl.[2] ..... E02F 3/72

[52] U.S. Cl. ..... 414/687; 180/139; 414/697

[58] Field of Search ..... 214/132, 138 R, 151, 214/621, 140; 180/51, 79.4, 79.5, 134, 136, 139, 140

[56] References Cited

U.S. PATENT DOCUMENTS

| | | | |
|---|---|---|---|
| 2,284,237 | 5/1942 | Stevenson | 214/671 |
| 2,408,359 | 10/1946 | Akers | 180/79.4 |
| 2,598,863 | 6/1952 | Tucker | 180/140 X |
| 3,237,781 | 3/1966 | Heigl | 212/49 |
| 3,439,937 | 4/1969 | Dixon | 180/139 X |
| 3,807,586 | 4/1974 | Holopainen | 214/138 R |

FOREIGN PATENT DOCUMENTS

| | | | |
|---|---|---|---|
| 1957285 | 6/1970 | Fed. Rep. of Germany | 180/51 |
| 2117529 | 11/1971 | Fed. Rep. of Germany | 180/51 |
| 2321383 | 11/1973 | Fed. Rep. of Germany | 180/139 |
| 235654 | 5/1969 | U.S.S.R. | 214/138 R |

*Primary Examiner*—L. J. Paperner
*Attorney, Agent, or Firm*—Armstrong, Nikaido, Marmelstein & Kubovcik

[57] ABSTRACT

An excavating and loading machine mounted on a wheeled type vehicle comprising front and rear frames having wheels rotatably mounted thereon, said front and rear frames being adapted to rotate relative to each other, and a vehicle body having an implement for effecting excavation and loading operations which is rotatably mounted on either of said front and rear frames.

A pair of hydraulically operated cylinders are provided between said front and rear frames for controlling steering of the vehicle.

4 Claims, 9 Drawing Figures

EXCAVATING AND LOADING MACHINE MOUNTED ON A WHEELED TYPE VEHICLE

BACKGROUND OF THE INVENTION

This invention relates to an excavating and loading machine adapted to be mounted on a wheeled type vehicle.

As for excavating and loading machine, there has heretofore been employed a crawler-type excavator. However, the crawler-type excavator is disadvantageous in that because of its poor mobility its movement from a work site to another required a long time. Although a kind of excavating and loading machine mounted on a wheeled type vehicle has also been known, it is limited to only small excavating and loading capacity mounted on a relatively small vehicle having wheels mounted on a single frame. This conventional loader mounted vehicle is, however, disadvantageous in that it is inferior in operational efficiency to the above-mentioned crawler-type excavator, and because of its excavating power being obtained by rotating its wheels during excavating work remarkable wear-down or consumption of tires is unavoidable.

Further, disclosed in French Pat. No. 2,252,455 is a loader mounted vehicle having articulated front and rear frames which can be turned relative to each other. According to this patent, however, the centre of gyration of the vehicle body having an implement is located on the rear frame so that it is required to form the rear frame larger than the front frame, and therefore the vehicle can not make a small turn at the time of steering.

SUMMARY OF THE INVENTION

It is an object of the present invention to provide an excavating and loading machine mounted on a wheeled type vehicle having excellent steering capabilities and efficient operabilities.

According to one aspect of the present invention, there is provided an excavating and loading machine mounted on a wheeled type vehicle comprising front and rear frames having wheels rotatably mounted thereon, said front and rear frames being adapted to rotate relative to each other, and a vehicle body having an implement for effecting excavation and loading operations which is rotatably mounted on either of said front and rear frames.

A pair of hydraulically operated cylinders are provided between said front and rear frames for effecting steering controls of the vehicle.

According to another embodiment of the present invention, frames of the vehicle are divided into three sections, i.e. front, intermediate and rear frames. The vehicle body having an implement in the front portion thereof is rotatably mounted on said intermediate frame to provide excellent mobility of the vehicle.

Other objects, features and advantages of the present invention will be readily apparent from the following description taken in conjunction with the accompanying drawings.

DETAILED DESCRIPTION OF THE INVENTION

Figure 1:
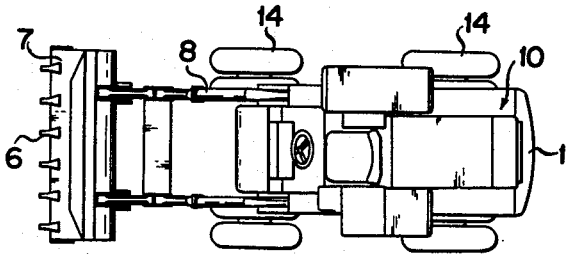
FIG. 1 is a plan view of the present invention.
Figure 2:
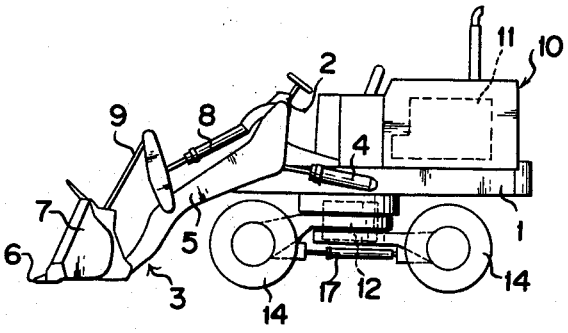
FIG. 2 is a side elevational view of FIG. 1.

The present invention will now be described in detail below by way of embodiments with reference to the accompanying drawings. In the drawings, reference numeral 1 denotes a rotatable vehicle body having a driver's cab 2 and an implement 3 mounted thereon. The implement 3 comprises a pair of lift arms 5 which can be moved up and down by a pair of hydraulically operated lift cylinders 4. Pivotally mounted on the leading ends of the pair of lift arms 5 is a bucket 7 having forwardly directed teeth 6. The bucket 7 can be pivoted through links 9 by means of a pair of tilt cylinders 8. Mounted in the rear part of the rotatable vehicle body 1 is a prime mover cab 10 in which an engine 11 is accommodated. The bottom part of the rotatable vehicle body 1 is connected through a gyrating arrangement 12 to bendable frame 13. The bendable frame 13 comprises a front frame **13*a* and a rear frame 13*b* each having large tire-mounted wheels 14. The upper portion of the rear frame 13*b* forms a hollow axial cylinder 15 having a bearing 16 mounted in the outer periphery thereof so that the upper part of the front frame 13*a* can be rotatably carried. A pair of steering cylinders 17 are mounted transversely between the front and rear frame 13*a* and 13*b* so that the front and rear frames can be turned about the axial cylinder 15 by the action of the steering cylinders 17**.

Whilst, the above-mentioned rotatable vehicle body 1 is rotatably carried through a bearing 18 on the upper part of the axial cylinder 15 of the rear frame **13*b*, and the gyrating arrangement 12 of the vehicle body 1 is mounted within the axial cylinder 15 and is constructed as mentioned below. Stated in brief, fixedly secured to the inner surface of the axial cylinder 15 is a ring gear 19 which is engaged with a pinion 21 of a gyrating motor 20 mounted on one side of the vehicle body 1 so that the vehicle body 1 can be gyrated 360 degrees by the gyrating motor 20**.

Figure 4:
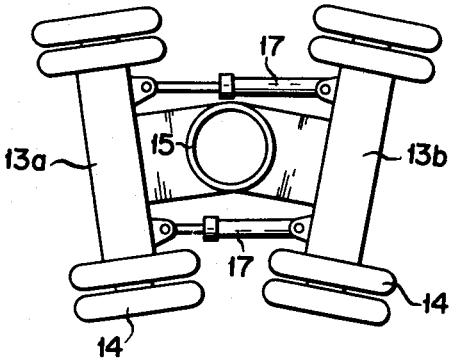
FIG. 4 is a schematic plan view showing connecting portion of the front and rear frames.

Thus, the excavating and loading machine constructed as mentioned above can be self-propelled by the wheels 14 mounted on the front and rear frames **13*a* and 13*b*, and its direction of movement can be changed by bending the front frame 13*a* relative to the rear frame 13*b* by the action of the steering cylinders 17 mounted therebetween as shown in FIG. 4. During excavating and loading operations, the vehicle is once stopped at the excavation site and the rotatable vehicle body 1 is permitted to gyrate by the gyrating motor 20 while excavation and loading operations are effected by the implement 3. Therefore, movement of the vehicle body back and forth for excavation and loading operations needed in the case of the conventional loader mounted vehicle can be eliminated, and so the operational efficiency can be improved remarkably and remarkable wear-down or consumption of wheels 14** can be avoided.

Figure 3:
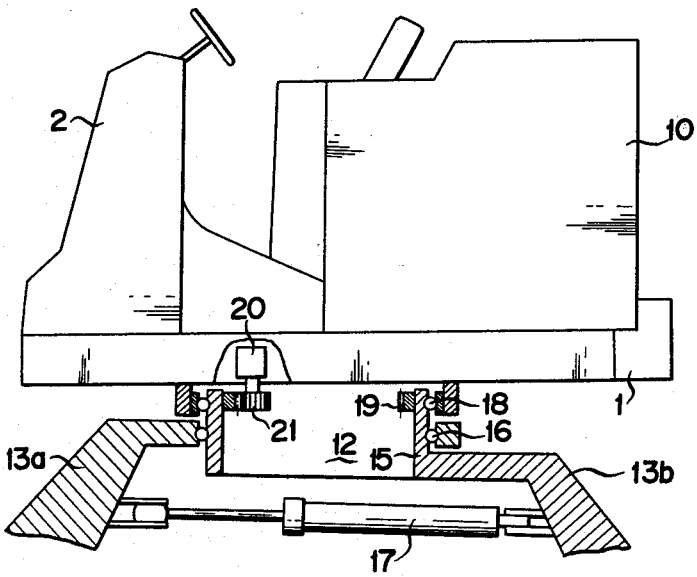
FIG. 3 is an enlarged side elevational view partly in cross-section showing rotating portion of the vehicle body with respect to frames.

Further, FIG. 3 shows an embodiment in which the axial cylinder 15 is formed on one end of the rear frame 13*b* so that the front frame 13*a* can be rotated about the axial cylinder 15, however; the arrangement may be made such that the axial cylinder 15 is formed on one end of the front frame 13*a* so that the rear frame 13*b* can be rotated about the axial cylinder 15.

Figure 5:
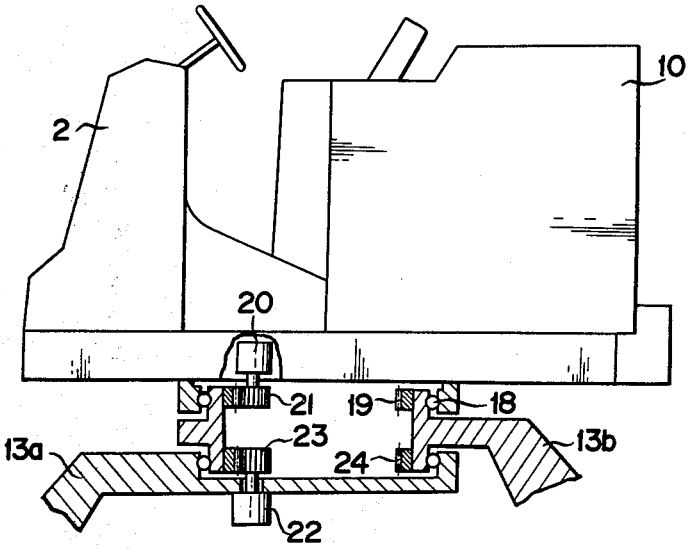
FIG. 5 is similar to FIG. 3 but showing another embodiment of the present invention.

FIG. 5 shows another embodiment of the present invention in which the rotatable or gyrating vehicle body 1 and the front frame 13*a* are rotatably mounted on the rear frame 13*b*, and the ring gear fixedly secured to the lower part of the axial cylinder 15 is engaged with the pinion 23 of the steering motor 22 mounted on the front frame 13*a* so that the front and rear frames 13*a* and 13*b* can be turned relative to each other by rotating the steering motor 22 forwardly and reversely.

Figure 6:
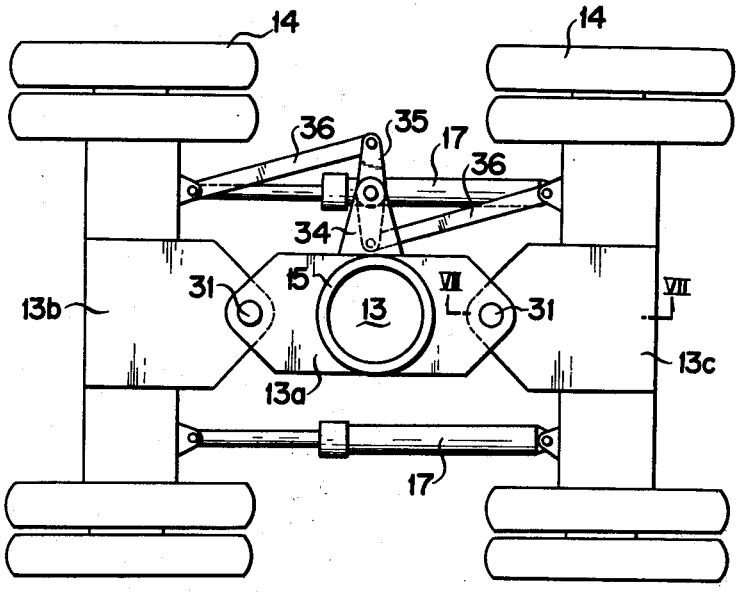
FIG. 6 is similar to FIG. 4 but showing still another embodiment of the present invention.
Figure 7:
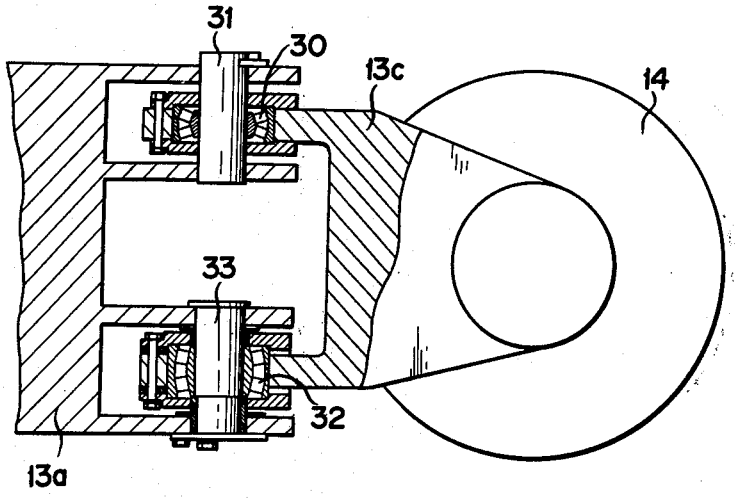
FIG. 7 is a cross-sectional view taken along the line VII—VII in FIG. 6.
Figure 8:
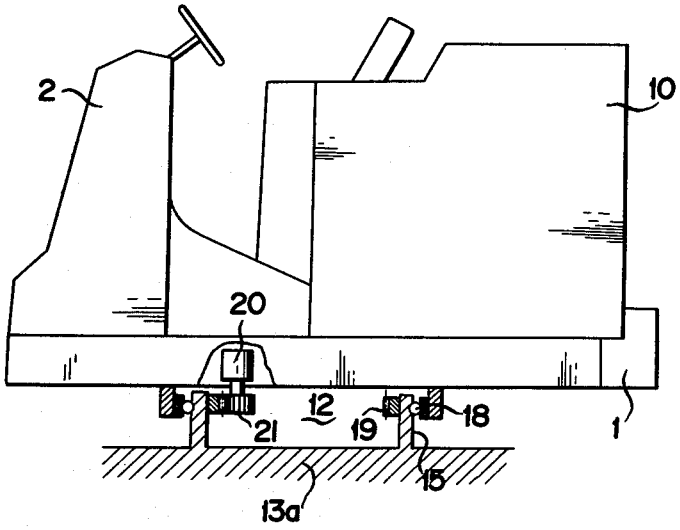
FIG. 8 is an enlarged side elevational view partly in cross-section showing rotating portion of the vehicle relative to the intermediate frame according to the embodiment of FIG. 6.

FIG. 6 shows a further embodiment of the present invention in which the turnable frame 13 comprises a central frame 13*a*, a front frame 13*b* and a rear frame 13*c* connected to the front and rear ends thereof, and as shown in FIG. 7, the upper part of the central frame is pivotally connected through a self-aligning roller bearing 30 to a rod 31 and the lower part thereof is pivotally connected through a tapered roller bearing 32 to a rod 33. Out of the front, rear and central frames 13*b*, 13*c* and 13*a*, each of the front and rear frames 13*b* and 13*c* has wheels 14 adapted to be driven or rotated by the aforementioned engine 11. Further, the front and rear frames 13*b* and 13*c* are interconnected by a pair of hydraulically operated steering cylinders 17 mounted on both sides of the central frame 13*a*. The steering cylinders 17 are connected in series through a steering manipulating valve not shown to a hydraulic fluid supply source.

Further, the central frame 13*a* has a bracket 34 protruding therefrom on one side thereof, and the leading end of the bracket 34 carries rotatably the intermediate portion of the bell crank 35. Pivotally mounted on both ends of the bell crank 35 are other ends of two lengths of links 36 one ends of which are pivotally connected to the front and rear frames 13*b* and 13*c*, respectively.

Whilst, the above-mentioned rotatable vehicle body 1 is rotatably carried through a bearing 18 by an axial cylinder 15 projecting from the central frame 13*a*, and the gyrating arrangement 12 of the vehicle body 1 is mounted within the axial cylinder 15 and is constructed as mentioned below. Stating in brief, fixedly secured to the inner surface of the axial cylinder 15 is a ring gear 19 which is engaged with a pinion 21 of a gyrating motor 20 mounted on the rotatable vehicle body 1 so that the vehicle body can be rotated 360 degrees by the gyrating motor 20.

Figure 9:
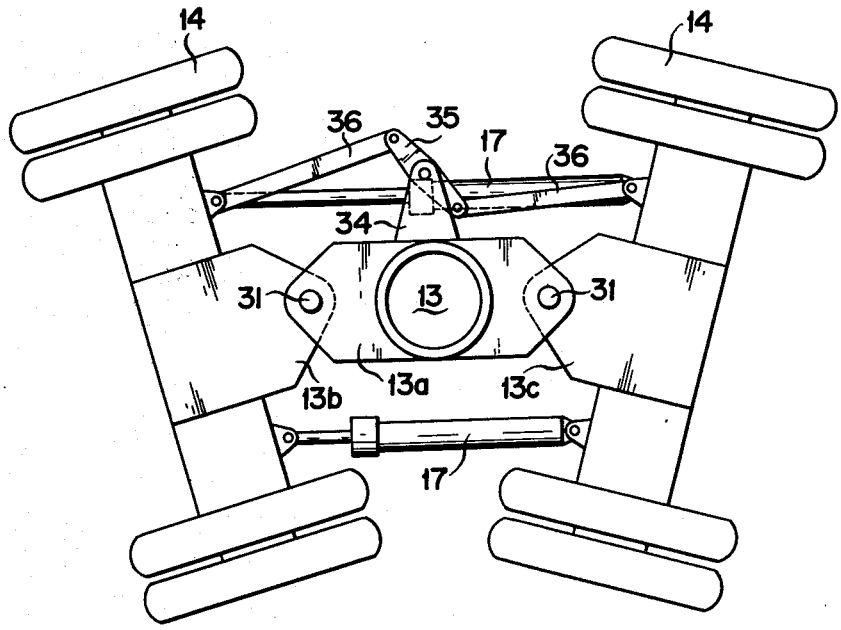
FIG. 9 is similar to FIG. 6 but showing a state wherein one of the hydraulic cylinders is operated to turn the vehicle.

Thus, the excavating and loading machine constructed as mentioned above can be self-propelled by the wheels 14 mounted on the front and rear frames 13*b* and 13*c*, and the direction of the vehicle can be changed by steering or turning the front and rear frames 13*b* and 13*c* relative to each other by the action of the hydraulically actuated steering cylinders 17 mounted therebetween as shown in FIG. 9.

Since various changes and modifications of the present invention will occur to and can be made readily by those skilled in the art without departing from the concept of the present invention, the invention is not to be taken as limited except by the scope of the appended claims.

What is claimed is:

1. An excavating and loading machine mounted on a wheeled type vehicle comprising:

a rear frame having wheels rotatably mounted thereon at both ends thereof, said rear frame having an axial cylinder formed thereon;

first bearing means mounted on a lower part of the outer periphery of said axial cylinder;

second bearing means mounted on an upper part of the outer periphery of said axial cylinder;

a front frame having wheels rotatably mounted thereon at both ends thereof, said front frame being rotatably mounted on said axial cylinder of said rear frame about said first bearing means;

a vehicle body having an implement for effecting excavation and loading operations, said vehicle body being rotatably mounted on said axial cylinder of said rear frame about said second bearing means;

first rotating means for rotating said front frame relative to said rear frame about said axial cylinder; and second rotating means for rotating said vehicle body about said axial cylinder wherein said second means comprises a ring gear fixedly secured to the inner surface of said axial cylinder, and a motor having a pinion attached thereto and fixedly secured to said vehicle body, said ring gear being adapted to mesh with said pinion.

2. The excavating and loading machine of claim 1 wherein said first rotating means comprises a pair of hydraulically operated cylinders interconnecting said front frame and said rear frame, whereby steering can be made by selectively extending or contracting a piston rod of either of said pair of cylinders.

3. The excavating and loading machine of claim 1 wherein said first rotating means comprises a ring gear fixedly secured to the inside of said axial cylinder, and a motor having a pinion attached thereto and being fixedly secured to said front frame.

4. An excavating and loading machine mounted on a wheeled type vehicle, comprising a front frame having wheels rotatably mounted thereon at both ends thereof;

a rear frame having wheels rotatably mounted thereon at both ends thereof;

an intermediate frame having an axial cylinder formed thereon, said intermediate frame being pivotally connected to said front and rear frames;

a vehicle body having an implement for effecting excavation and loading operations which is rotatably mounted on said axial cylinder;

a pair of hydraulically operated cylinders mounted on both sides of said intermediate frame for interconnecting said front frame and said rear frame;

rotating means for rotating said vehicle body about said axial cylinder, said rotating means including a ring gear fixedly secured to the inside of said axial cylinder, and a motor having a pinion attached thereto and being fixedly secured to said vehicle body, said ring gear being adapted to mesh with said pinion;

a bracket fixedly secured to said intermediate frame;

a bell crank pivotally mounted on said bracket; and a linkage interconnecting said front frame and said rear frame through said bell crank.

* * * * *